US005535732A

United States Patent [19]

Recagno

[11] Patent Number: 5,535,732

[45] Date of Patent: Jul. 16, 1996

[54] DIAMOND-STUDDED TOOL FOR DRESSING GRINDERS, WITH A CONE-SHAPED ROLLING MEANS, ON AN OBLIQUE AXIS

[75] Inventor: Pietro Recagno, Milan, Italy

[73] Assignee: Redis S.r.l., Milan, Italy

[21] Appl. No.: 137,178

[22] PCT Filed: May 31, 1991

[86] PCT No.: PCT/IT91/00046

§ 371 Date: Oct. 21, 1993

§ 102(e) Date: Oct. 21, 1993

[87] PCT Pub. No.: WO92/19422

PCT Pub. Date: Nov. 12, 1992

[30] Foreign Application Priority Data

May 3, 1991 [IT] Italy ..... MI91A1204

[51] Int. Cl.[6] ..... B24B 53/04

[52] U.S. Cl. ..... 125/11.01; 125/39

[58] Field of Search ..... 125/11.03, 11.02, 125/11.01, 36, 37, 39, 27, 28; 451/443, 557, 461

[56] References Cited

U.S. PATENT DOCUMENTS

| | | | |
|---|---|---|---|
| 2,324,942 | 7/1943 | Meeson et al. | 125/39 |
| 2,353,236 | 7/1944 | Hammill et al. | 125/11.02 |
| 2,380,451 | 7/1945 | Koebel | 125/11.02 |
| 2,462,716 | 2/1949 | Booth | 125/39 |

FOREIGN PATENT DOCUMENTS

| | | | |
|---|---|---|---|
| 2040984 | 1/1971 | France . | |
| 1953544 | 6/1971 | Germany . | |
| 1514590 | 10/1989 | U.S.S.R. | 125/11.01 |
| 0543633 | 3/1942 | United Kingdom | 125/39 |
| 0546401 | 7/1942 | United Kingdom | 125/39 |
| 743343 | 1/1956 | United Kingdom . | |
| 0907375 | 10/1962 | United Kingdom | 125/11.01 |
| 0916294 | 1/1963 | United Kingdom | 125/11.02 |

*Primary Examiner*—Robert A. Rose
*Attorney, Agent, or Firm*—Michael J. Striker

[57] ABSTRACT

Tool (10) with diamonds (35) (35') (36) for dressing grinders (90) having a roller (11) rotating on a supporting shank (20) round an axis that intersects the axis of the shank (20) at an angle of 45°, with operative areas (30) (31) having one or more diamonds (35) (35') (36) placed at equal angular distances or continuously over a conical geometrical surface (16) with a taper of 90° so as to be intersected by the geometrical plane passing along the axis of rotation and the axis of the shank according to a straight line orthogonal to the latter. Ref. FIGS. 1 and 3.

18 Claims, 7 Drawing Sheets

FIG. 6
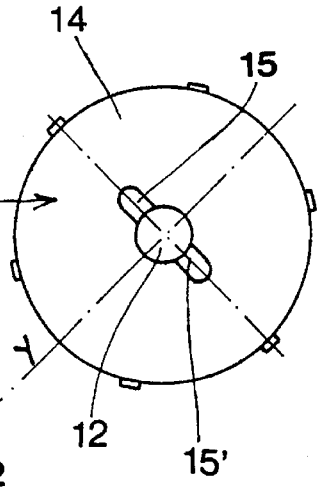
FIG. 4
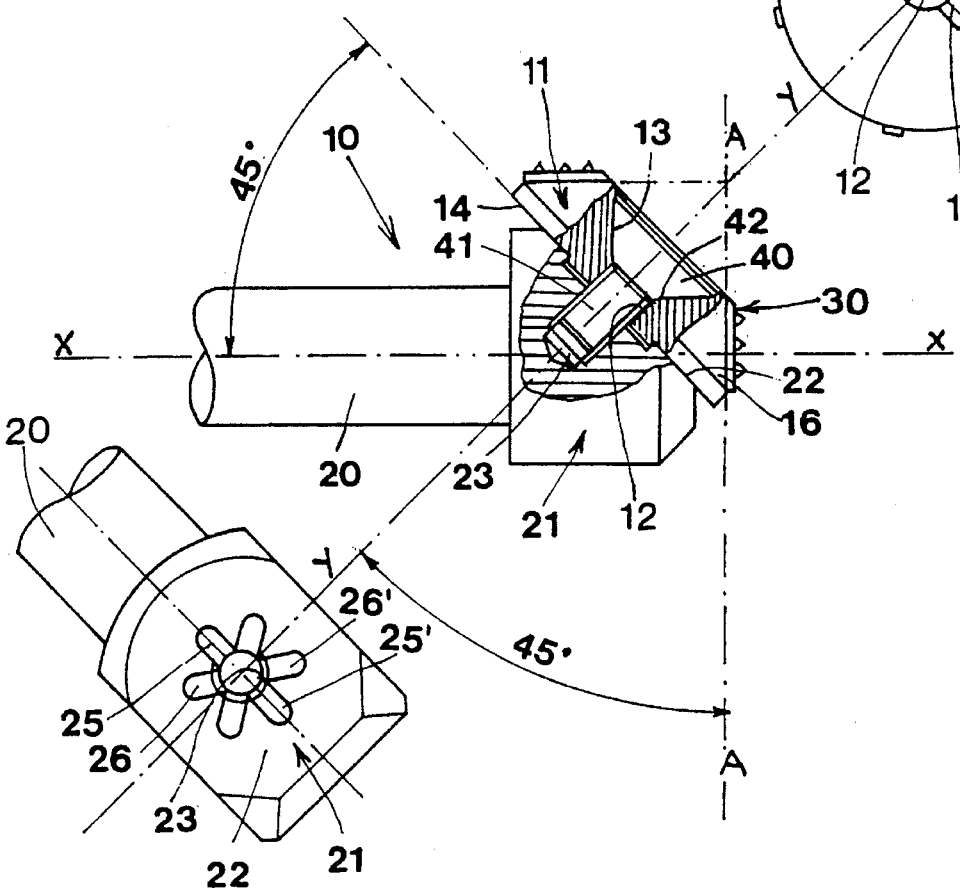
FIG. 5

FIG. 7
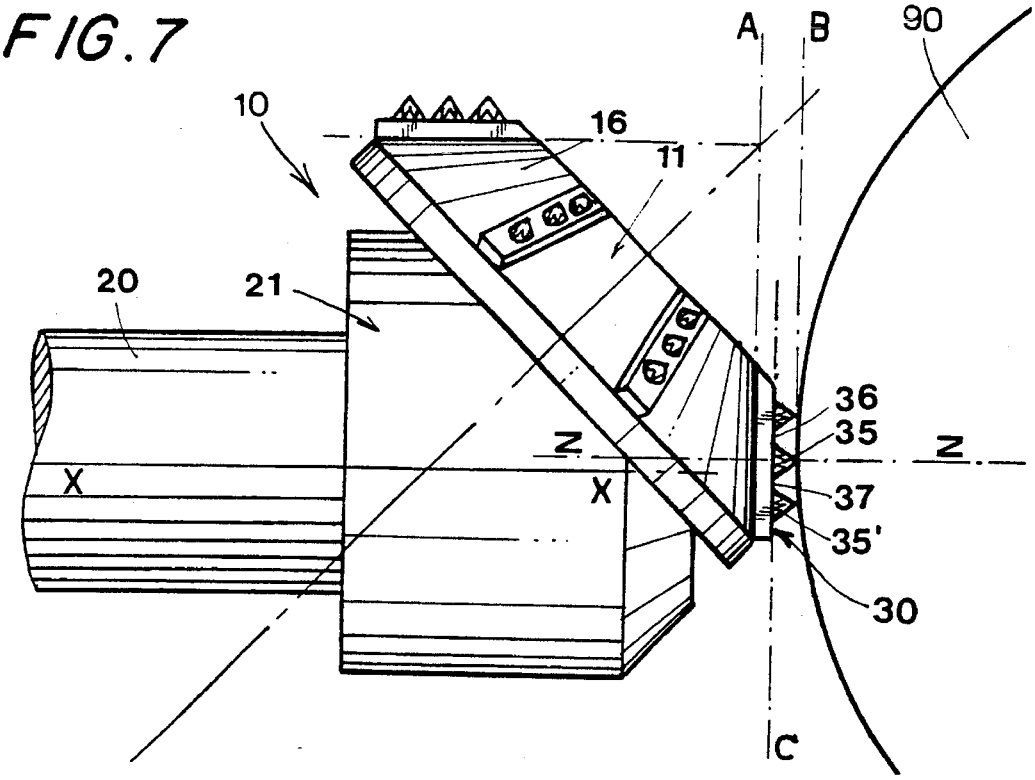
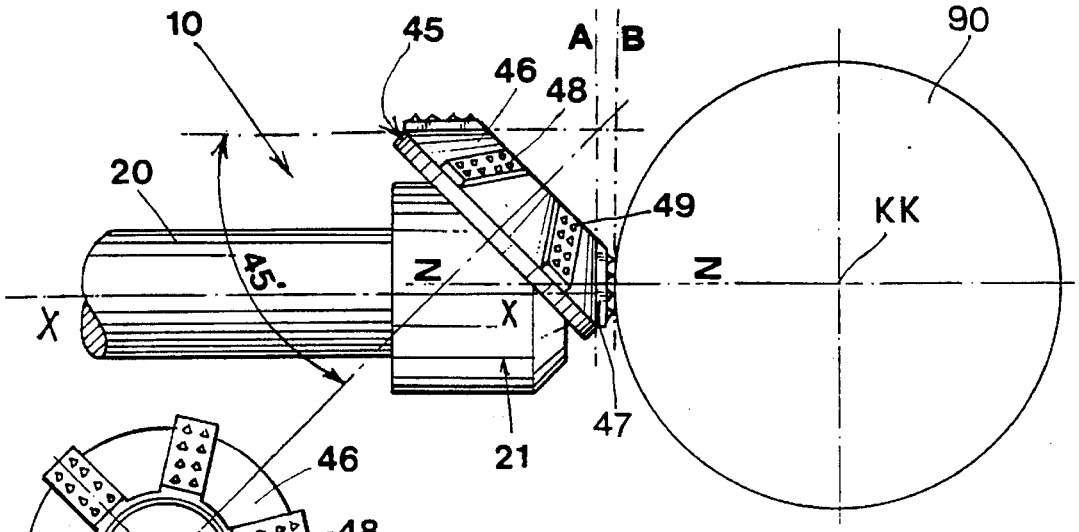
FIG. 8
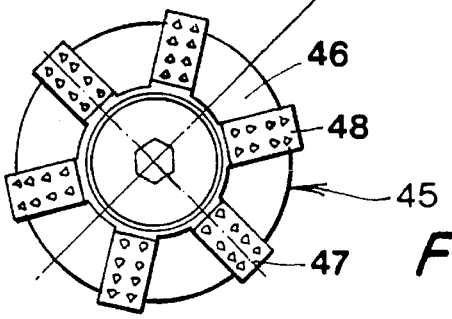
FIG. 9

FIG. 10
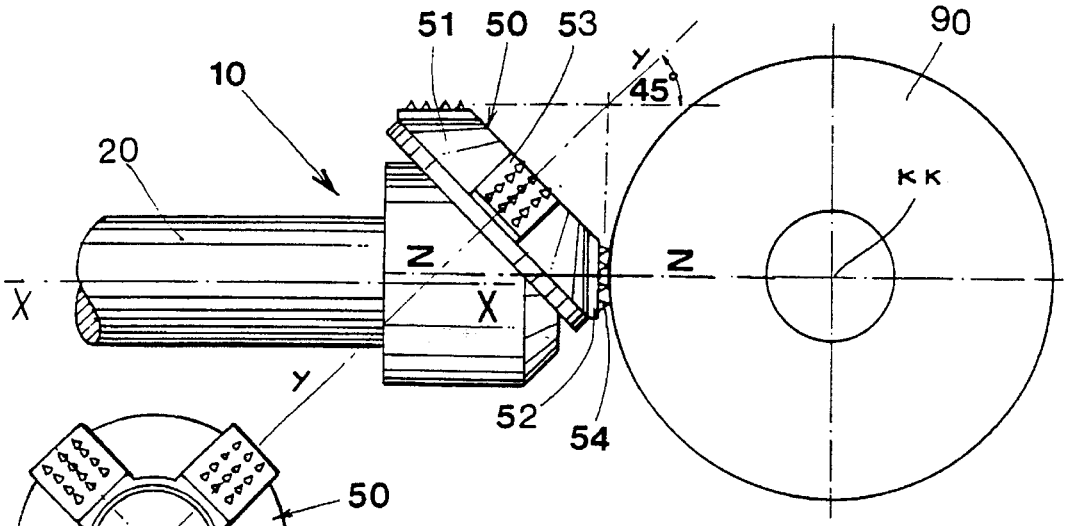
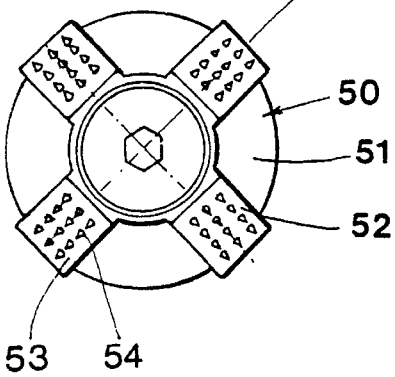
FIG. 11
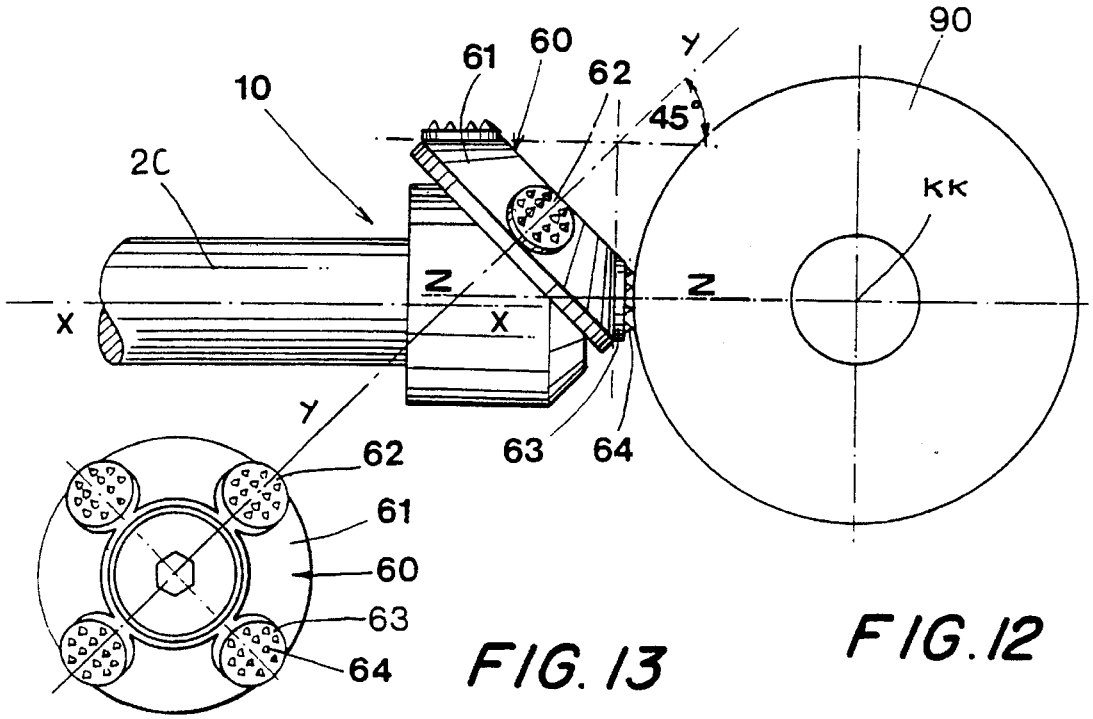
FIG. 13
FIG. 12

DIAMOND-STUDDED TOOL FOR DRESSING GRINDERS, WITH A CONE-SHAPED ROLLING MEANS, ON AN OBLIQUE AXIS

The invention concerns diamond-studded tools, especially those for dressing grinders.

For this purpose use is generally made of tools with diamonds, especially tools having a shank on which a roller can rotate around an axis orthogonal to that of said shank, said roller having a certain number of diamonds lodged in its cylindrical surface at equidistant radial positions.

Figure 22:
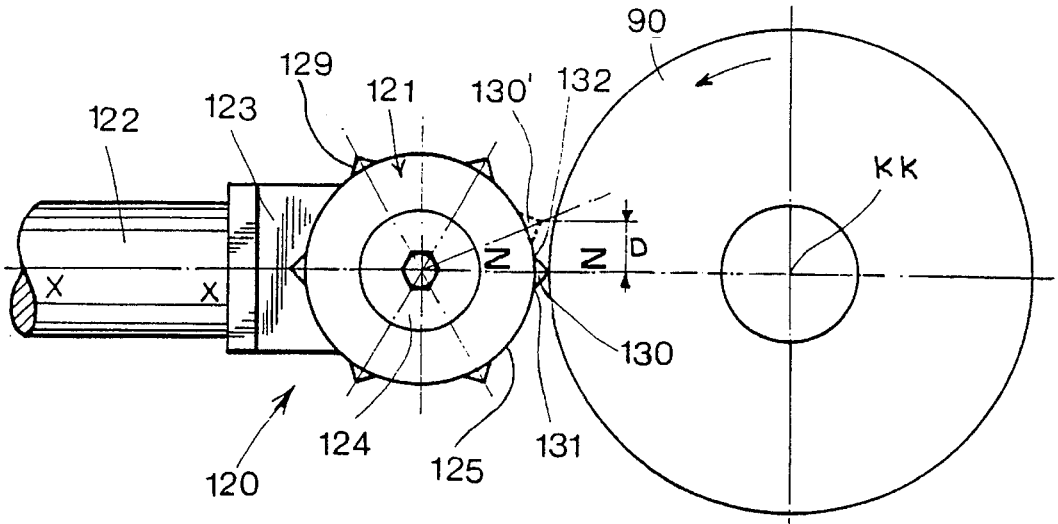
Figure 23:
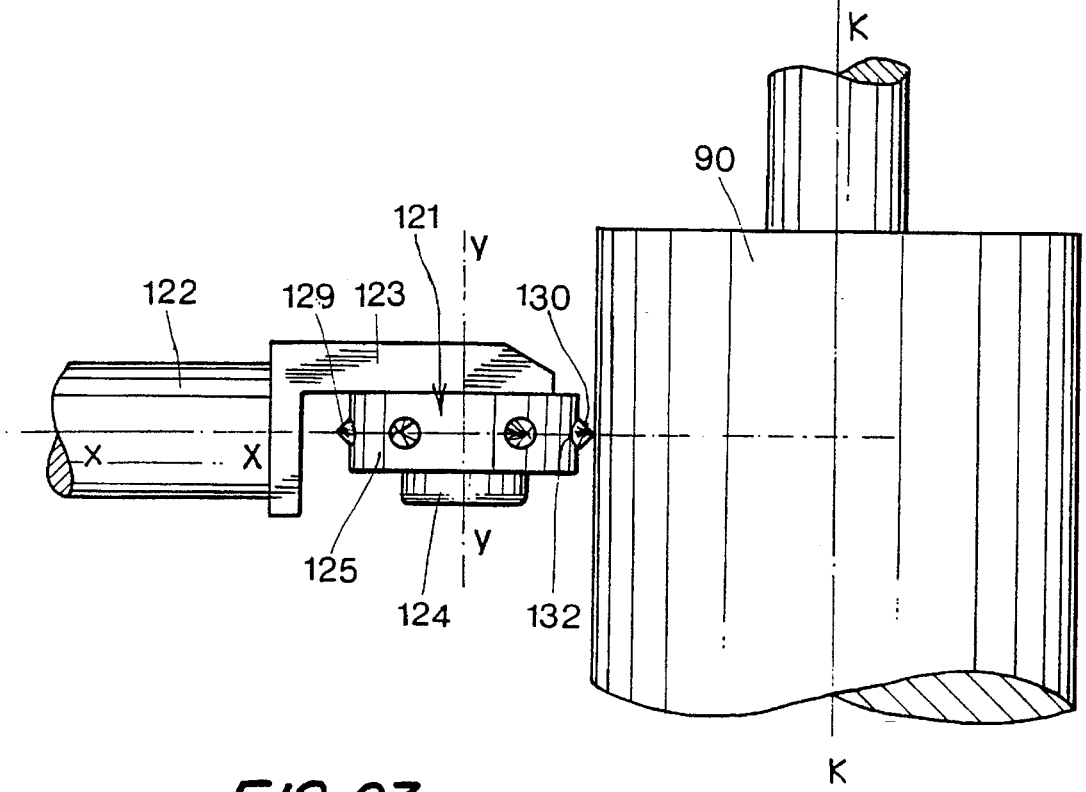

When a diamond becomes worn down it is replaced with another by rotating the roller after loosening a central screw which is tightened again afterwards. FIGS. 22 and 23 illustrate one of these tools, with diamonds 129 and 130.

It is known that the tool 120 is most effective when the ZZ axis of the operating diamond 130, coinciding with the XX axis of the shank 122, intersects the KK axis of rotation of the grinder 90.

But frequently this optimum set-up is interfered with by errors in angular set of the roller 121 which can lead to incorrect setting, at 130', of the diamond 130 moving it to D, distant from the XX axis of the shank that intersects the KK axis of the grinder 90.

Further, since the roller's rotation axis YY is substantially parallel to the grinder's rotation axis KK, due to moments of force set up by the grinder itself, considerable stresses are created on the diametrical edges 131 132, of the seat holding the operating diamond 130,aligned on an arc of the cylindrical surface of said roller 121.

Since, due to curvature of the roller 121, said edges lie farthest from the point of the diamond 130, said diamond becomes easily loosened and dislodged.

As the axis of the roller is parallel to that of the grinder 90, the forces set up by the grinder are exerted tangentially on said roller 121 and tend to make it rotate; further, as the point of the diamond 130 lies at a considerable distance from the roller's axis, there is much vibration in the tool during its work which adversely affects its stability and operational accuracy.

The above invention eliminates these drawbacks and also offers other advantages as will be explained below. Subject of the invention is a diamond-studded tool, for dressing grinders, rotating on the shank of a support round an axis that obliquely intersects the axis of the shank. The operative areas with diamonds are spread over a geometrical conical surface or over planes tangential to said surface.

The best effects are achieved when the geometrical conical surface so tapers that the plane, on which lie the axis of rotation and that of the shank, intersects the operative areas according to a straight line practically orthogonal to the axis of the shank.

It is an advantage if obliquity of the axis of rotation with respect to the axis of the shank is practically 45° and, similarly, if tapering of the geometrical conical surface is about 90°.

The flat operative areas may be arranged, as the case may be, on the conical surface at an equal angular distance, or be spread in a continuous manner over said conical surface.

Said operative areas may be all equal or may be wholly or partially different, and may comprise one or more diamonds preferably on lines coinciding with the radius of the geometrical conical surface or on lines parallel to said radius.

The points of the diamonds are placed along geometrical flat surfaces at tangents to the geometrical conical surface or else are placed along said surface. Geometrical form of the operative areas may vary and may especially be rectangular, square, circular.

In other executions the operative areas are made from a compound composed of a powder of diamonds and of sintered metal.

By means of special devices the tool may rotate freely and may be locked as desired either in any angular position or at intersection, according to a line orthogonal to the axis of the shank, of one or other operative areas with the plane on which lie the axes of rotation and of the shank.

In this way a worn area may be replaced with a fresh one or an area of one kind with another of a different kind. The advantages of the invention are clear.

The diametrical edges of the seats holding the diamonds, lying on the same plane as that of the axis of the shank and of tool rotation, since they lie on a straight line, ensure the maximum reaction of movements of force which, due to grinder rotation, tend to dislodge the diamond.

An error, even of some size, in angular setting of the tool round its own axis and therefore of the diamond becomes reduced, because of the obliquity of the tool's axis, to the value of its orthogonal projection on the geometrical plane passing through the axes of the tool and of its shank, thus becoming negligible.

Since the axis of rotation of the tool lies on a plane that is orthogonal to the axis of the grinder, and since the operative areas lie at a short distance from the axis of rotation, vibrations are greatly lessened.

Characteristics and purpose of the invention will become still clearer by the following examples of its execution illustrated by diagrammatic drawings.

Figure 1:
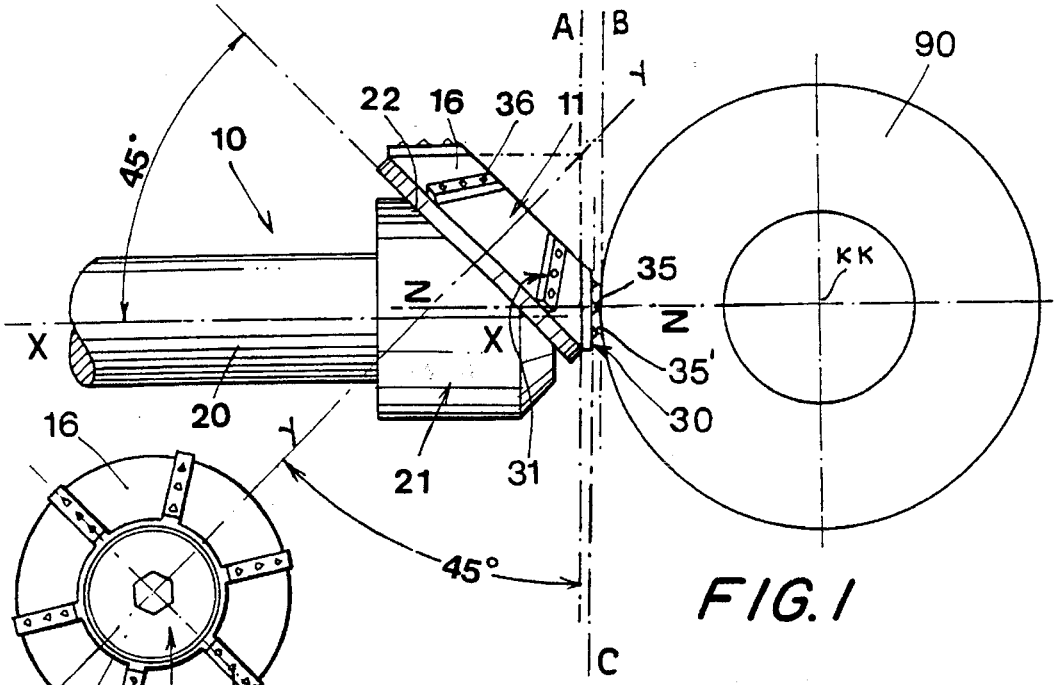

FIG. 1 Side view of the invented tool with six flat rectangular operative areas each with three diamonds, in a working position.

Figure 2:
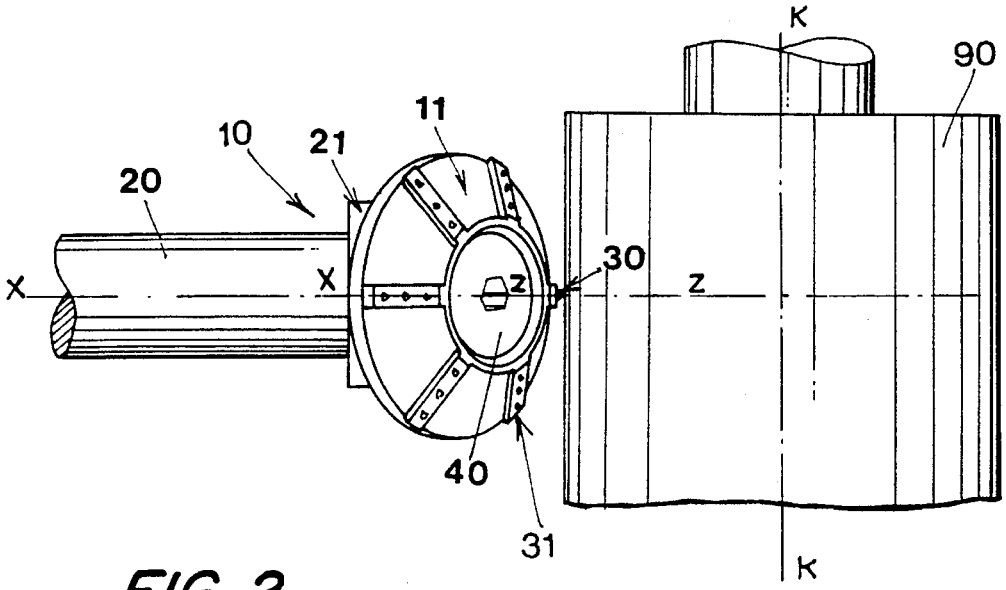

FIG. 2 Plan view of the above.

Figure 3:
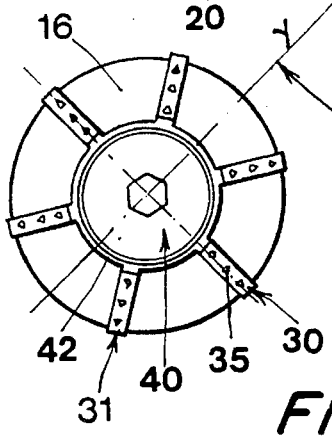

FIG. 3 Detail of the tool, plan view.

FIG. 4 Cross section of the tool, in working position.

FIG. 5 The shank at the resting plane of the tool, plan view.

FIG. 6 Back of the tool, plan view.

FIG. 7 Enlarged detail of FIG. 1.

FIG. 8 Tool with six flat rectangular areas each with eight diamonds, side view.

FIG. 9 Plan view of FIG. 8.

FIG. 10 Side view of tool with six flat rectangular areas each with twelve diamonds.

FIG. 11 Plan view of FIG. 10.

FIG. 12 Side view of the tool with four flat circular areas, each with twelve diamonds.

FIG. 13 Plan view of FIG. 12.

Figure 14:
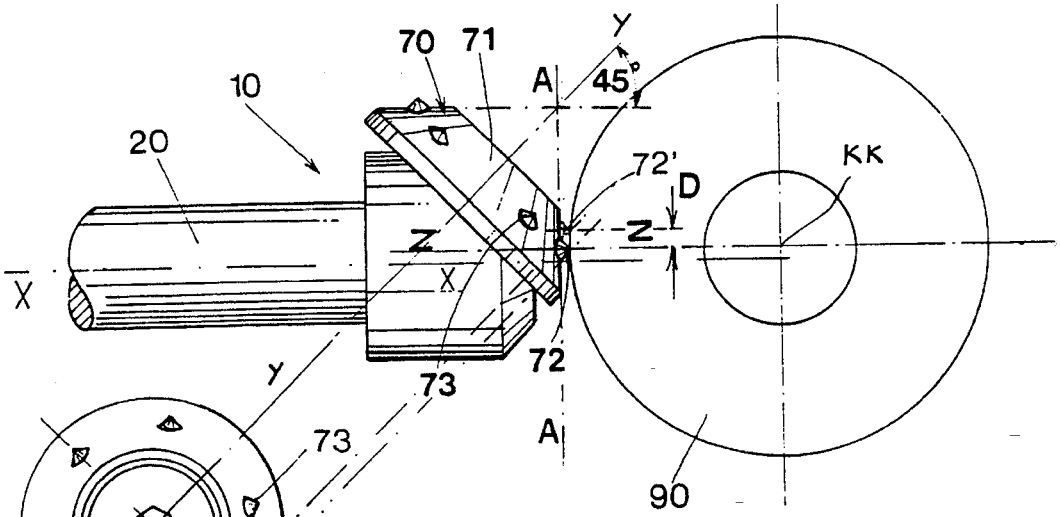

FIG. 14 Side view of the tool with six diamonds.

Figure 15:
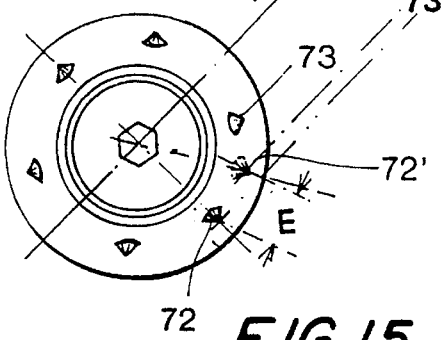

FIG. 15 Plan view of FIG. 14.

Figure 16:
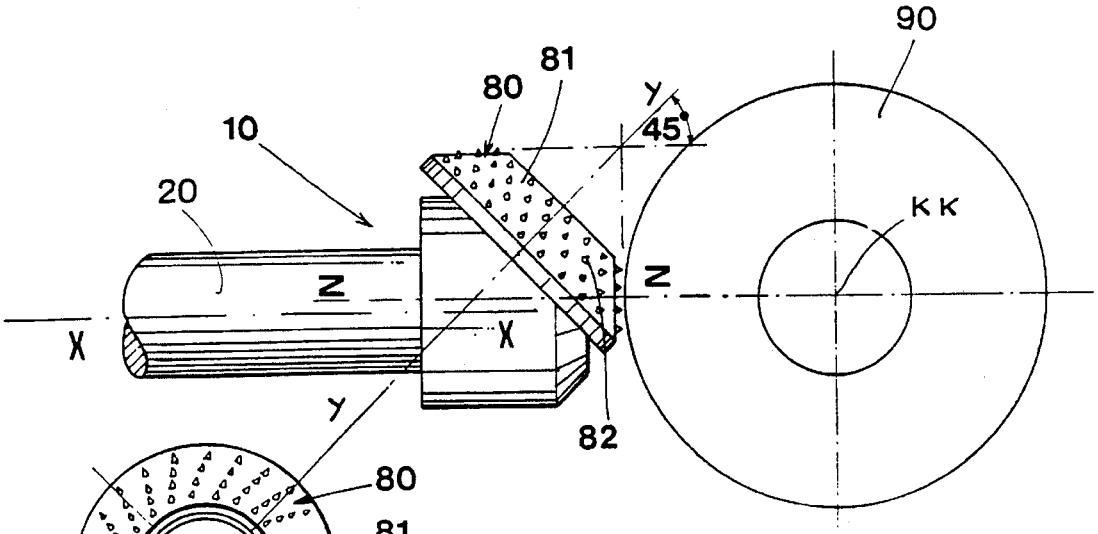

FIG. 16 Side view of tool with diamond-studded conical surface.

Figure 17:
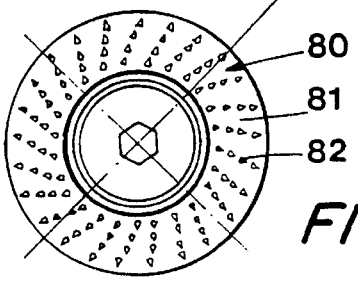

FIG. 17 Plan view of FIG. 16.

Figure 18:
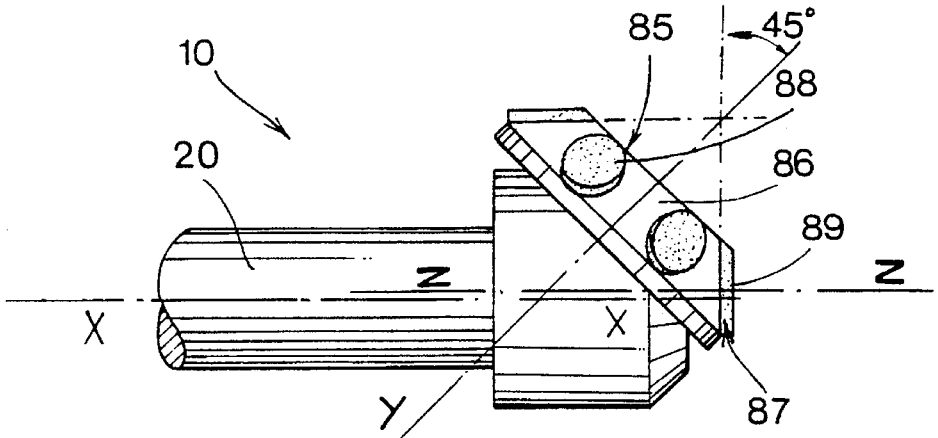

FIG. 18 Tool with six areas of a sintered paste of diamond granules, side view.

Figure 19:
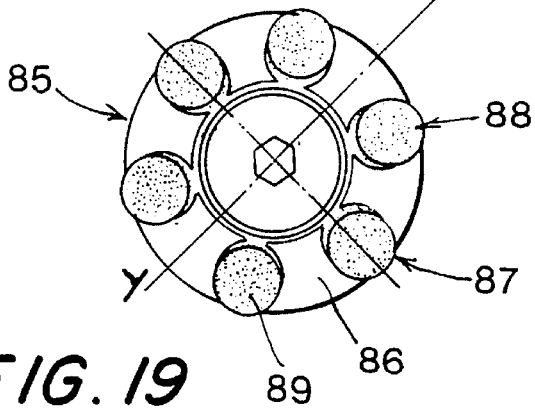

FIG. 19 Plan view of FIG. 18.

Figure 20:
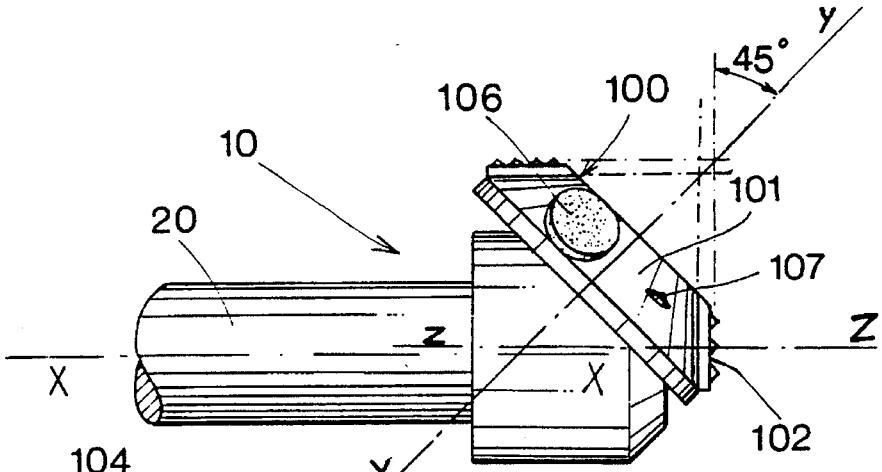

FIG. 20 Side view of tool with six different operative areas.

Figure 21:
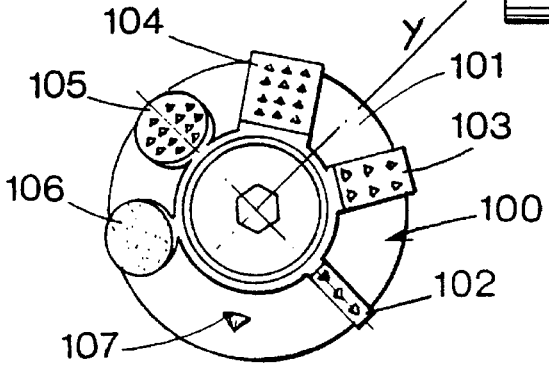

FIG. 21 Plan view of FIG. 20.

FIG. 22 Side view of a known type of this tool in a working position.

FIG. 23 Plan view of FIG. 22.

On the tool 10 there is a conical roller 11 turning on the head 21 of the shaft 20 around an axis YY at an angle of 45° with respect to the axis of the shaft XX.

Said roller is mounted on the front plane 22 of said head, orthogonal to the axis YY, by means of a socket-head screw 40 which screws through the hole 12 in the roller by its threaded stem 41 into the threaded hole 23 in the head.

The countersunk head 42 of the screw lodges in the corresponding seat 13 of the roller on whose back 14 there is a pair of oblong diametrical projections 15 15' which fit closely into one or other of the pairs of diametrical seats 25 25', 26 26' placed at the same angular distance on the plane 22 of the shank's head 21.

The roller 11 can rotate round the screw 40 whose YY axis is orthogonal to said plane 22 and intersects the XX axis of the shank.

On loosening the screw 40 the roller can be turned by moving the pair of diametrical projections 15 15' into one or other of the seats 25 25' or 26 26'.

On tightening the screw again the roller will be firmly fixed in the required position.

The conical surface 16 of the roller has a 90° taper and is therefore tangential to a plane orthogonal to said axis XX traced on the plane in FIGS. 1, 4 and 7 and marked A. Spaced equally on said conical surface are flat, tangential rectangular expansion areas 30 31. Their angular position in relation to the projections 15 15' on the back of the roller is such that a plane passing through the axis of the shank crosses at a right angle one of these expansions, 30 in FIGS. 1, 4 and 7, orthogonal to said axis.

Three diamonds 35 35' and 36 are inserted in a radial row in the expansions, their points being virtually bounded by a plane orthogonal to the XX axis of the shank, traced and marked B in FIGS. 1 and 7.

Each diamond has an axis ZZ orthogonal to the plane tangential to the conical surface of the roller, and therefore at an angle of 45° with respect to the axis of rotation and lying on the plane on which said axis of rotation lies, or parallel to said axis ZZ.

When the expansion area reaches the plane on which lie the axis of the shank and that of rotation and is oriented towards the tip of the tool, axis ZZ of each diamond will be parallel to said axis XX and may therefore intersect with the axis KK of the grinder 90, namely in the position where efficiency will be greatest.

With reference to FIG. 1, it can be seen that the roller 11 opposes to the grinder 90, with axis KK for dressing, a flat area 30 orthogonal to the axis ZZ of each diamond 35 35' indicated by a traced line marked C parallel to the preceding traced lines marked A and B, and therefore the diamonds 35 35' benefit from being most securely fixed at point 36 and at the opposite point 37 at the contour where the maximum moments of reaction forces are generated by the grinder (FIG. 7).

When angular position of the roller is changed to replace the expansion area holding worn out diamonds by another, the position taken up by the fresh expansion is practically the same as that of the former one.

Any errors of angle there may be, bearing in mind that roller axis obliquity is 45°, cause only negligible movement of diamond axis in relation to the optimum position at its intersection with axis KK of the grinder 90.

FIGS. 8 and 9 show the tool 10 with a roller 45 similar to the roller 11 but having six flat rectangular expansion areas 47 48 tangential to the conical surface 46 with two parallel rows of four conical diamonds 49 whose ends are virtually bounded by a plane (tracing marked B) orthogonal to the axis XX.

Each diamond has an axis ZZ orthogonal to the conical surface of the roller 45 and therefore parallel to the axis XX of the shank.

FIGS. 10 and 11 illustrate the tool 10 with a roller 50 similar to roller 11 but having four flat rectangular expansions 52 53 tangential to the conical surface 51 with three parallel rows of four diamonds each 54.

FIGS. 12 and 13 show the tool 10 having a roller 60 with four flat circular expansion areas 62 63 tangential to the conical surface 61 with four parallel rows of diamonds 64.

The tool 10 in FIGS. 14 and 15 has a roller 70 that carries six diamonds 72 73 at equal angular distances, with a ZZ axis orthogonal to the conical surface 71 where it meets said surface and where it thus intersects axis YY of the roller and axis KK of the grinder 90 that is being dressed. Clearly an angular irregularity E between the correct position 72 of the diamond with axis ZZ intersecting the grinder axis KK and the incorrect angle 72' will, when projected onto the axis A (FIG. 4), become a small fraction, D, of said axis with respect to axis ZZ.

FIGS. 16 and 17 show a tool 10 and roller 80 with conical surface 81 onto which numerous diamonds 82 are fixed,also with a ZZ axis orthogonal to said conical surface.

FIGS. 18 and 19 show a tool with roller 85 whose conical surface 86 has six flat circular expansions 87 88 tangential to said surface at equal angular distances, said expansions consisting of a compound 89 comprising a powder of diamonds and of sintered metal.

The axis ZZ of said expansions is similarly orthogonal to the conical surface 86.

In FIGS. 20 and 21 a tool 10 with roller 100 has a conical surface 101 with six expansions at equal angular distances, consisting respectively of rectangular areas 102 with one row of three diamonds, 103 with two rows of three diamonds, 104 with three rows of four diaponds, 105 circular with twelve diamonds, 106 circular and made from a compound consisting of a powder of diamonds and sintered metal, 107 with one diamond.

I claim:

1. A tool for dressing grinders, comprising a supporting shaft having an axis; and a roller turning around said supporting shaft and having an axis of rotation which obliquely intersects said axis of said shaft, said roller having a plurality of operating areas provided with diamonds and spread over a geometrical conical surface to insure maximum reaction against a moment of forces generated by the grinder on points of said diamonds by edges of seats in which said diamonds are lodged, to limit effects of errors in angular setting of said roller and to reduce a distance between said operative areas and said axis of rotation of said roller and thus to lessen vibrations said operating areas being arranged so that said axis of said shaft intersects at least one of said operating areas.

2. A tool as defined in claim 1, wherein said operative areas are located on planes which are tangential to said geometrical conical surface of said roller.

3. A tool as defined in claim 1, wherein said geometrical conical surface has a taper such that a plane on which said axis of rotation of said roller and said axis of said shaft lie intersects said operative areas according to a straight line which is substantially octagonal to said axis of said shaft.

4. A tool as defined in claim 1 wherein said axis of rotation of said roller is inclined relative to said axis of said shaft by substantially 45°, said taper of said geometrical conical surface being substantially 90°.

5. A tool as defined in claim 1 wherein said operative areas are disposed continuously around said conical surface.

6. A tool as defined in claim 1, wherein said operative areas are flat, placed at equal angular distances and are all equal size.

7. A tool as defined in claim 1, wherein said operative areas are flat, placed at equal angular distances and are different.

8. A tool as defined in claim 1, wherein said operative areas include at least one diamond arranged on lines coinciding with a radius of said geometrical conical surface.

9. A tool as defined in claim 1, wherein said operative areas include at least one diamond arranged on lines extending parallel to a radius of said geometrical conical surface.

10. A tool as defined in claim 1, wherein said operative areas consist a compound comprising powdered of diamond and sintered metal.

11. A tool as defined in claim 1, wherein said diamonds have points which are disposed along flat geometrical surfaces which are tangential to said conical geometrical surface.

12. A tool as defined in claim 1, wherein said diamonds have points which are disposed along flat geometrical surfaces which extend along said geometrical conical surface.

13. A tool as defined in claim 1, wherein said operative areas have a circular geometrical form.

14. A tool as defined in claim 1, wherein said operative areas have a rectangular geometrical form.

15. A tool as defined in claim 1, wherein said operative areas have a square geometrical form.

16. A tool as defined in claim 1, wherein said operative areas have different geometrical forms.

17. A tool as defined in claim 1, and further comprising means for providing free rotation of said roller and for looking of said roller as desired both at any angular setting and at intersection, according to a line which is substantially orthogonal to said axis of said shaft, of one or other of said operative areas with a plan on which lies said axis of rotation of said roller and said axis of said shaft for replacement either of a worn area or of an area of one type with an area of a different type.

18. A tool for dressing grinders, comprising a supporting shaft having an axis; and a roller turning around said supporting shaft and having an axis of rotation which obliquely intersects said axis of said shaft, said roller having a plurality of operating areas provided with diamonds and spread over a geometrical conical surface to insure maximum reaction against a moment of forces generated by the grinder on points of said diamonds by edges of seats in which said diamonds are lodged, to limit effects cf errors in angular setting of said roller and to reduce a distance between said operative areas and said axis of rotation of said roller and thus to lessen vibrations, said geometrical conical surface having a taper such that a plane on which said axis of rotation of said roller and said axis of said shaft lie intersects said operative areas according to a straight line which is substantially octagonal to said axis of said shaft, said axis of rotation of said roller being inclined relative to said axis of said shaft by substantially 45°, said taper of said geometrical conical surface being substantially 90°, said diamonds having points which are disposed along flat geometrical surfaces which are angularly spaced from one another.

* * * * *